US005511634A

United States Patent [19]

Bahjat et al.

[11] Patent Number: 5,511,634

[45] Date of Patent: Apr. 30, 1996

[54] INSTANTANEOUS ELEVATOR UP-PEAK SECTOR ASSIGNMENT

[75] Inventors: Zuhair S. Bahjat, Farmington; Thomas R. Bean, Simsbury, both of Conn.

[73] Assignee: Otis Elevator Company, Farmington, Conn.

[21] Appl. No.: 318,487

[22] Filed: Oct. 5, 1994

Related U.S. Application Data

[63] Continuation of Ser. No. 124,135, Sep. 20, 1993, abandoned.

[51] Int. Cl.[6] ..... B66B 1/20

[52] U.S. Cl. ..... 187/383; 187/385

[58] Field of Search ..... 187/380, 382, 187/383, 385, 387, 389

[56] References Cited

U.S. PATENT DOCUMENTS

| | | | |
|---|---|---|---|
| 4,691,808 | 9/1987 | Nowak et al. | 187/125 |
| 4,792,019 | 12/1988 | Bittar et al. | 187/125 |
| 4,804,069 | 2/1989 | Bittar et al. | 187/125 |
| 4,991,694 | 2/1991 | Friedli | 187/127 |
| 5,146,053 | 9/1992 | Powell et al. | 187/127 |
| 5,202,540 | 4/1993 | Auer et al. | 187/101 |
| 5,274,202 | 12/1993 | Kezer et al. | 187/125 |
| 5,300,739 | 4/1994 | Bittar | 187/127 |
| 5,382,761 | 1/1995 | Amano | 187/383 |

FOREIGN PATENT DOCUMENTS

| | | |
|---|---|---|
| 5-201630 | 8/1993 | Japan . |

*Primary Examiner*—Robert Nuppi

[57] ABSTRACT

Instantaneous car assignment is combined with sectoring for providing an elevator dispatching scheme in which, in response to a hall call registered at the lobby, a car not assigned to a sector and having the lowest remaining response time of all such cars is assigned to the next available sector and the sector assignment is displayed to passengers immediately on a screen in the lobby.

1 Claim, 6 Drawing Sheets

MACHINE ROOM "MR"
MAIN FLOOR (LOBBY) "L"
SN=3
SN=2
SN=1
13
10
9
5
5
2
FROM 40
PL
32
GROUP CONTROL
CPU
POS...CC
POS...CC
DRIVE & MOTION CONTROL
CPU
30
HC
LW
SI
CC
U
D
12
14
16
18
1
2
3
4
10-13
5-9
2-5

INSTANTANEOUS ELEVATOR UP-PEAK SECTOR ASSIGNMENT

This is a continuation of application Ser. No. 08/124,135, filed on Sept. 20, 1993, now abandoned.

TECHNICAL FIELD

This invention relates to elevator dispatching.

BACKGROUND ART

Prior art elevator dispatching schemes include one or more schemes of dividing the floors of a building into sectors and assigning cars to serve sectors. For example, car one may serve floors 1–5, car 2 serves floors 6–10, etc. The scheme has the advantage that waiting and service times are reduced because each car is only serving a few floors rather than the whole building.

Instantaneous car assignment assigns a car to a hall call as soon as the hall call is registered and activates a lobby gong and/or hall lantern to tell the passenger which car to move to. The benefit is that a passenger can begin moving toward the elevator which ultimately will take him to his destination right after entering the hall call. The sectoring scheme described above has the disadvantage that assignment of a hall call to a car is not displayed to the passenger until the car reaches a stop control point seconds before the car arrives at the lobby. Therefore, the passenger is waiting after entering the hall call without knowing which car will serve him.

DISCLOSURE OF THE INVENTION

According to the present invention, instantaneous car assignment is combined with sectoring for providing an elevator dispatching scheme in which, in response to a hall call registered at the lobby, a car not assigned to a sector and having the lowest remaining response time of all such unassigned cars is assigned to the next available sector and the sector assignment is displayed to passengers immediately on a screen in the lobby.

BEST MODE FOR CARRYING OUT THE INVENTION

Figure 1:
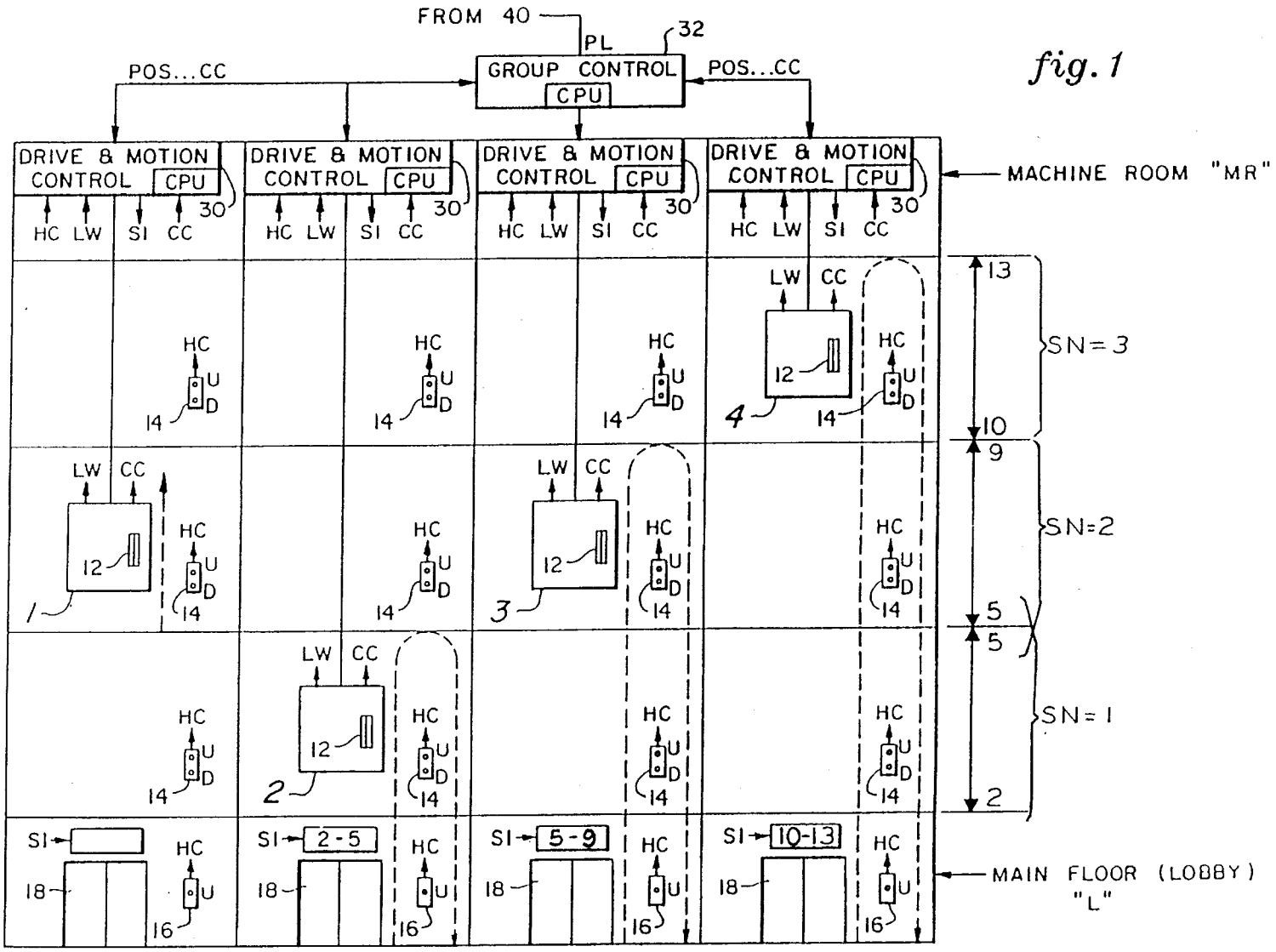
FIG. 1 is a functional block diagram of an elevator system in which the present invention may be applied.

An exemplary multi-car, multi-floor elevator application, with which the exemplary system of the present invention can be used, is illustrated in FIG. 1. Elevator cars 1–4 serve a building having a plurality of floors. The building has an exemplary 13 floors above a main floor, typically a ground floor or lobby (L). However, some buildings have their main floor at some intermediate or other portion of the building, and the invention can be adapted to them as well. Each car 1–4 contains a car operating panel (COP) 12 through which a passenger may make a car call to indicate a destination floor by pressing a button on the COP, producing a signal (CC), identifying the floor to which the passenger intends to travel. On each of the floors there is a hall fixture 14 through which a hall call (HC) is provided to indicate the intended direction of travel by a passenger on the floor. At the lobby (L), there is also a hall call fixture 16, through which a passenger calls the car to the lobby.

The depiction of the elevator system in FIG. 1 is intended to illustrate the selection of cars during an up-peak period, according to the invention, at which time the floors 2–13 above the main floor or lobby (L) are divided into an appropriate number of sectors depending upon the number of cars in operation and the traffic volume, with each sector containing a number of contiguous floors assigned in accordance with the criteria and operation used in the present invention.

The number of sectors into which the building is divided may change based on variations in the values of system traffic parameters and hence the building traffic. These traffic parameters may be car load weight (LW), or hall calls (HC) or car calls (CC). The number of sectors into which the building is divided will be greater than or equal to 1, not a constant. The number of sectors is assigned such that each sector carries a volume of traffic approximately equal to that of any other sector. At the lobby, there is a floor service indicator (FSI) for each car which shows the temporary, current selection of available floors exclusively reachable from the lobby by the car assigned to that sector, which assignment changes throughout the up-peak period. For distinguishing purposes each sector is given a sector number (SN) and each car is given a car number (CN).

The assignment of floors to sectors shown in FIG. 1 represents only the sectors being used at a particular instant in time. The assignment of floors to the sectors shown, and consequently the division of the floors of the building into sectors, is dynamic, based on traffic variations. As empty cars arrive at the lobby, they are assigned to sectors in "round robin" fashion. Each car receives a sector assignment as it arrives at the lobby. If, for example, car 4 has just left the lobby and cannot be given a new sector assignment car, one will receive the assignment as soon as it gets to the lobby.

FIG. 1 shows an exemplary floor-car-sector assignment. Car 1 is allowed to be unassigned to a sector; car 2 (CN=2), is assigned to serve the first sector (SN=1). Car 3 (CN=3) serves the second sector (SN=2), and car 4 (CN=4) serves the third sector (SN=3). As Car 1 is not assigned to a sector it may serve none of the floors. The floor service indicator (FSI) for car 2 will display, for example, floors 2–5, the presumed floors assigned to the first sector for this example, to which floors that car will exclusively provide service from the lobby. Car 3 similarly provides service to a second sector, consisting of the floors assigned to that sector, for example floors 6–9, and the FSI for car 4 will show those floors. The FSI for car 4 indicates floors 10–13, the floors assigned to a third sector. Because of the round-robin assignment of cars to sectors, Car 1, though not functioned at the instant shown, will be assigned the next available sector in the order.

The FSI for car 1 is not illuminated, showing that it is not serving any particular sector at this particular instant of time during the up-peak sectoring sequence reflected in FIG. 1.

Each car will only respond to car calls that are made in the car from the lobby to floors that coincide with the floors in the sector assigned to that car. Car 4, for instance, will only respond to car calls made at the lobby to floors 10–13. It will take passengers from the lobby to those floors (provided car calls are made to those floors) and then return to the lobby empty, unless it is assigned to a hall call.

This system can collect data on demand throughout the day, by means of car call and hall call activations, for example, to arrive at a historical record of traffic demands for each day of the week and compare it to actual demand to adjust the overall dispatching sequences.

Figure 2:
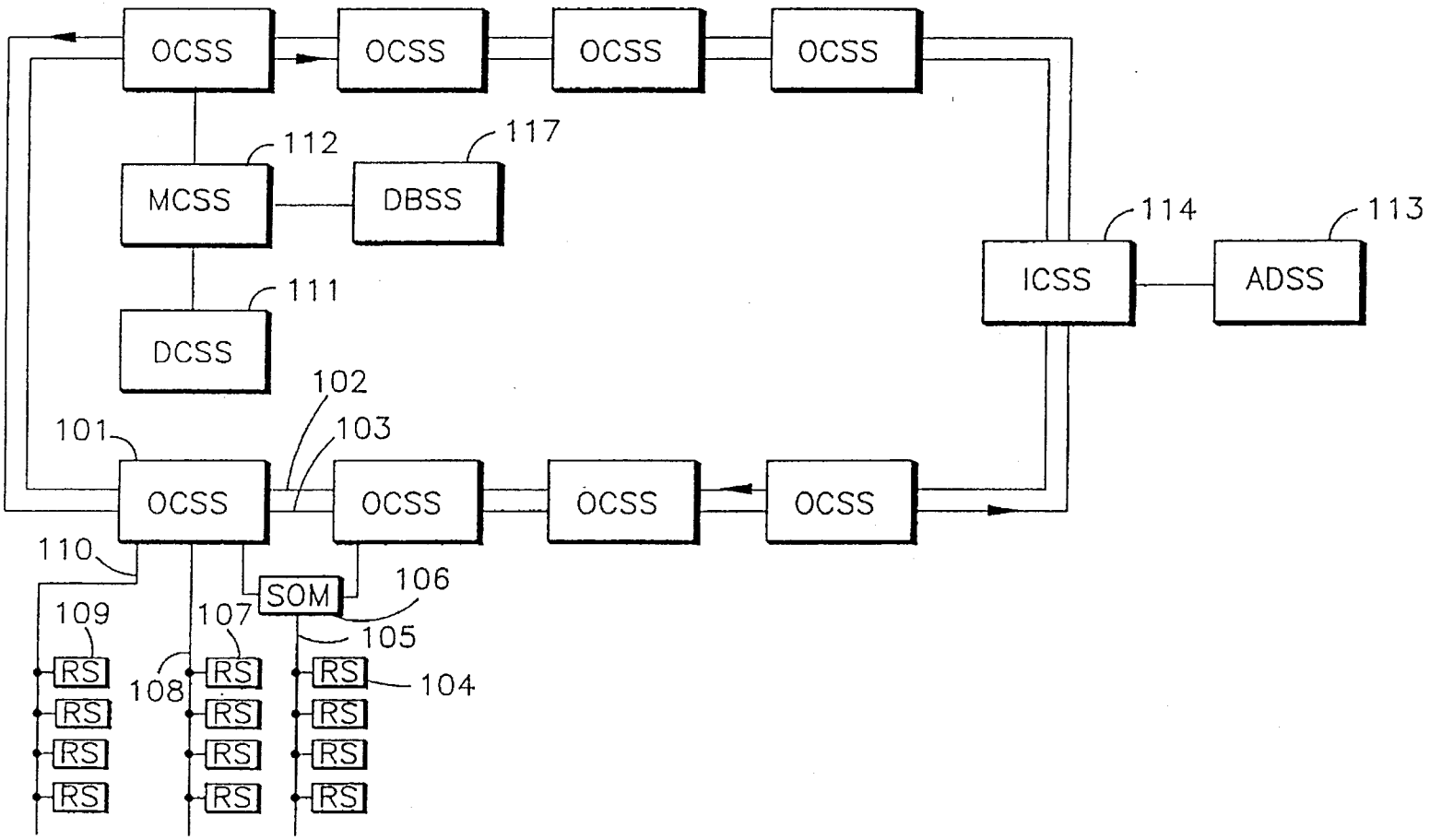
fig. 2 prior art
FIG. 2 is a block diagram of a elevator control system using ring communication.

Signals HC and CC are read by an OCSS 101 associated with the car and then communicated to all OCSSs 101 via a ring communication system (FIG. 2) for computation of the relative system response. As described in the RSR patent "Relative System Response Call Assignments" U.S. Pat. No. 4,323,142 to Bittar, incorporated herein by reference, load weight (LW) is read by a motion control subsystem (MCSS) 112, the maximum and minimum values during a time interval are taken and converted to an average load weight and communicated to an ADSS 113 via the ICSS 114 and the ring communication system for conversion to boarding and deboarding counts. Given this traffic data, predictions are made and communicated by means of a ring communication system (FIG. 2). There are four microprocessor systems associated with every elevator. FIG. 2 shows an eight car group, each car having one operational controller subsystem (OCSS) 101, one door control subsystem (DCSS) 111 and one motion control subsystem (MCSS) 112 and a drive brake subsystem (DBSS) 117. Such a system may be found in application Ser. No. 07/029,495 (Attorney Docket No. TO-522), entitled "Two-Way Ring Communication System for Elevator Group Control" by Auer and Jürgen (filed Mar. 23, 1987) now issued as U.S. Pat. No. 5,202,540.

There, the task of elevator dispatching may be distributed to separate microprocessor systems, one per car. These microprocessor systems, known as operational control subsystems (OCSS) 101, are all connected together via two serial links (102, 103) in a two way ring communication system. FIG. 2 shows an eight car group configuration. For clarity purposes MCSS (112) and DCSS (111) are only shown in relation to a specific OCSS 101; however, it is to be understood that there would be eight sets of these systems, one set to correspond with each elevator.

Hall buttons and lights, i.e., the elevator group related fixtures as opposed to car related fixtures, are connected with remote stations 104 and remote serial communication links 105 to the OCSS 101 via a switch-over module (SOM) 106. The car buttons, lights and switches are connected through remote stations 107 and serial links 108 to the OCSS 101. Car specific hall features, such as car direction and position indicators, are connected through remote stations 109 and a remote serial link 110 to the OCSS 101.

The car load measurement is periodically read by a DCSS 111. This load is sent to MCSS 112. DCSS 111 and MCSS 112 are microprocessor systems controlling door operation and car motion under the control of the OCSS 101.

The dispatching function is executed by the OCSS 101, in conjunction with an advanced dispatcher subsystem (ADSS) 113, which communicates with the OCSS 101 via an information control subsystem (ICSS) 114. The ICSS acts as a communication interface between the elements connected to the ring (OCSSs) and the ADSS 113. The measured car load is converted into boarding and deboarding passenger counts by MCSS 112 and sent to OCSS 101. Each OCSS 101 sends this data to the ADSS 113 via ICSS 114.

The ADSS 113, through signal processing, collects the passenger boarding and deboarding traffic data and car departure and arrival data at the lobby, so that, in accordance with its programming, it can predict traffic conditions at the lobby for predicting the start and end of peak periods, for example up-peak and down-peak. The ADSS 113 determines passenger boarding and deboarding counts at other floors and car arrival and departure counts for use in up-peak sectoring and for varying penalties based on predicted traffic. For further information on these techniques see U.S. Pat. No. 4,363,381, "Relative System Response Call Assignments", U.S. Pat. No. 4,323,142, "Dynamically Reevaluated Elevator Call Assignments" both to Bittar, and a magazine article entitled "Intelligent Elevator Dispatching System", by Nader Kameli and Kandasamy Thangavelu (*AI Expert*, Sept. 1989; pp. 32–37). The disclosures of the aforementioned patents are incorporated herein by reference.

The system can collect data on individual and group demands throughout the day to arrive at a historical record of traffic demands for each day of the week and compare it to real-time demand to adjust the overall dispatching sequences to achieve a prescribed level of elevator system performance. Further, historical and real-time traffic data are used to make traffic predictions based upon these data. Following such an approach, car load, percentage of car capacity filled (car load divided by car capacity), average waiting time, and lobby traffic may be determined through signals (LW), from each car, that indicate car load for each car.

Figure 3:
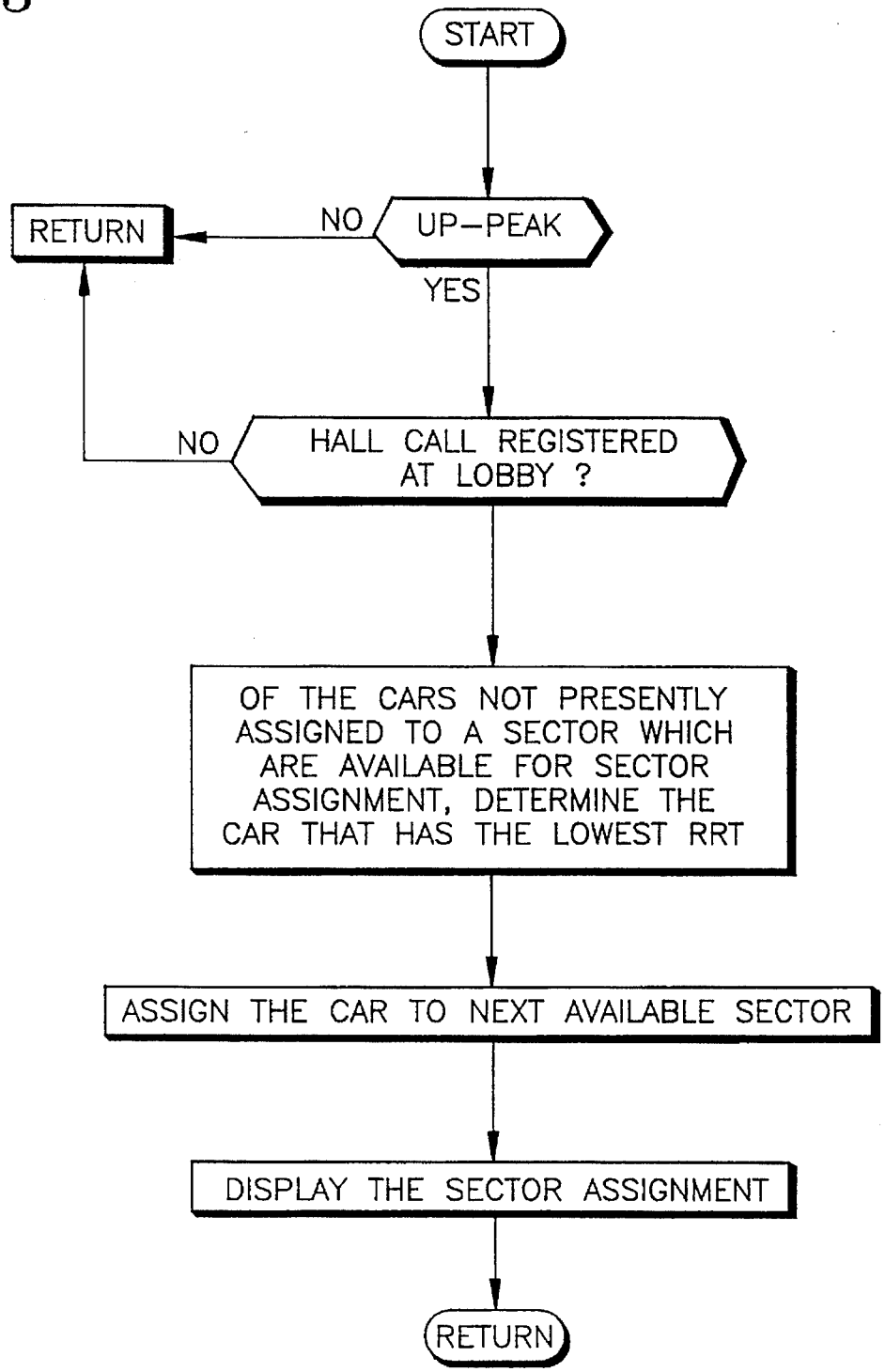
FIG. 3 is a flow chart for implementing instantaneous car assignment to a sector, or in effect an instantaneous sector assignment.

FIG. 3 is a flow chart for implementing instantaneous car assignment (ICA) to a sector or, in effect, an instantaneous sector assignment. If ICA is in effect and the elevator system is on up-peak and a hall call is registered, among the cars not assigned to a sector, the one with the lowest remaining response time (RRT) will be to the lobby call. If these two conditions are not met, the routine of FIG. 3 is exited. RRT is an estimation of the amount of time required for an elevator to reach the commitment point of the floor at which the hall call is registered, given the car calls and hall calls to which the elevator car is committed. Alternatively, Remaining Response Time may be defined as an estimation of the amount of time required for an elevator to reach the floor at which the hall call is registered, given the car calls and hall calls to which the elevator car is committed. Up-peak is conditioned on the turning on of an up-peak clock(triggered in the morning) and two cars leaving the lobby partially loaded. The term remaining response time is described in U.S. Pat. No. 5,146,053 entitled "Elevator Dispatching Based on Remaining Response Time", issued to the same assignee as the present invention. RRT is sometimes referred to in the elevator industry as estimated time of arrival (ETA).

Continuing with the routine of FIG. 3, the car with the lowest RRT which is not assigned to a sector is now assigned to a sector and the sector assignment displayed on the FSI in the lobby for passengers to see.

Organization and construction of sectors is not the invention and may be performed in a myriad of ways. The gist of the present invention is instantaneous assignment of a car to a sector, however that sector is arrived at and with the understanding that a sector broadly includes any allotment of multiple floors to be serviced by a limited number of floors less than the all cars available for assignment. An exemplary method of allotting floors to service by a limited number of cars is described below in a sectoring algorithm. Instantaneous assignment of a car to sectors in any of a number of ways is equivalent. A dynamic assignment routine is described in U.S. Pat. No. 4,846,311, assigned to OTIS ELEVATOR COMPANY.

Figure 4A:
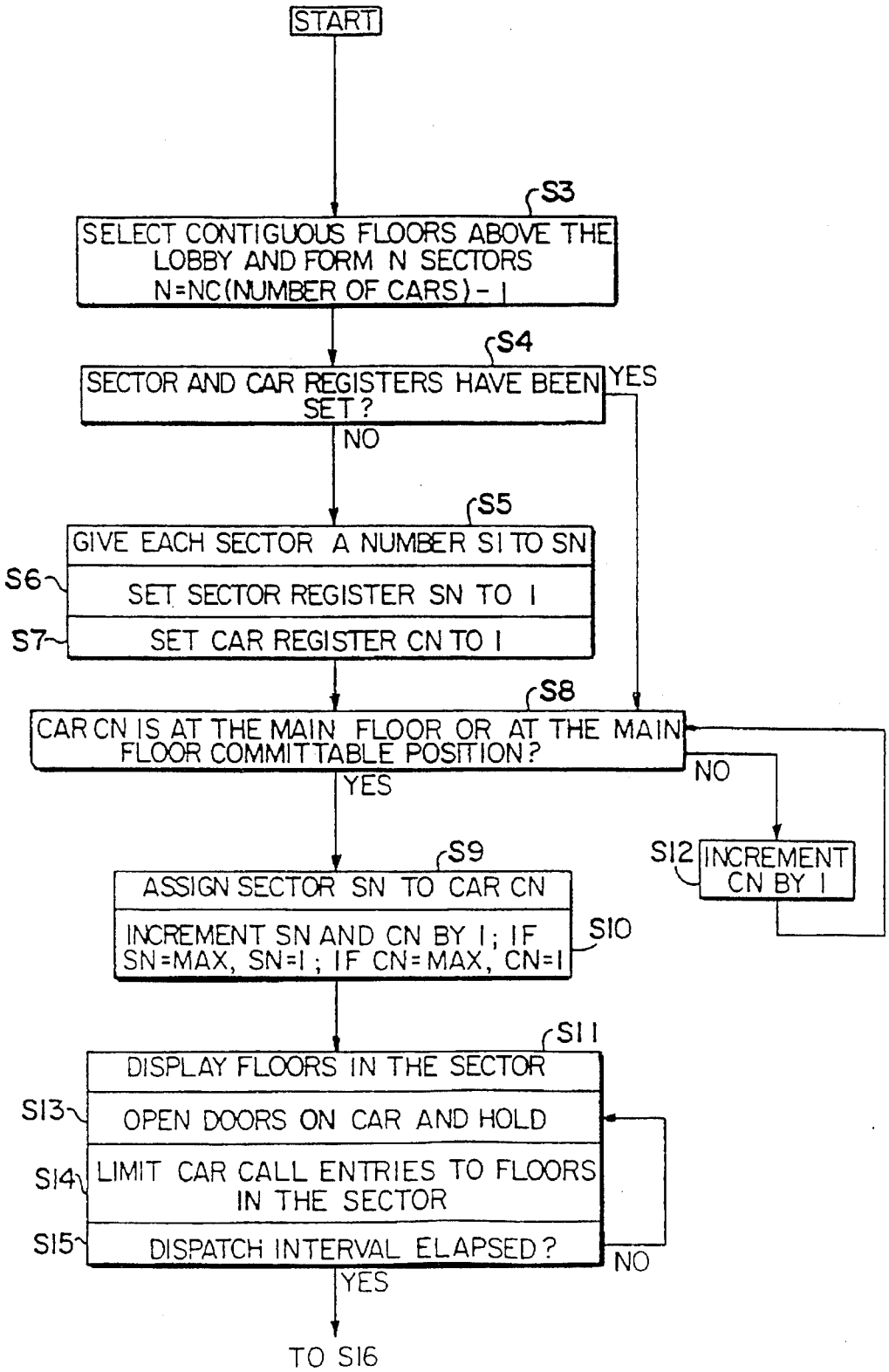
fig. 4A prior art
FIGS. 4A, 4B, 4C are logic diagrams for implementing a sectoring routine.

FIG. 4A shows a portion of the sectoring algorithm. In step 3, the number of sectors "N" is equal to the number of cars (NC) minus 1. For instance, in FIG. 1, there are three sectors and four cars. Hall call assignment may be made according to the description below.

In FIG. 4A, in step 4, a test is made that determines that the up-peak sectoring routine has been previously entered, which could have resulted in the performance of step 3, in which each sector is given a number and, in the performance of step 4 in which a sector register in the controller is set to 1, presumably the lowest SN and in the performance of step 5, in which a similar car register is set to the lowest car number (CN), presumably 1. For the purposes of illustration, in FIG. 1, the sector serving floors 2–5 has an SN of 1, the sector serving floors 6–9 has an SN of 2, and the sector serving floors 10–13 has an SN of 3. Car 1 would have a CN of 1, car 2 a CN of 2, car 3 a CN of 3, and car 4 a CN of 4. CN and SN can be assumed to be initialized at 1. The sequence is illustrated by the flow chart's attempt to assign a sector to car 1, starting with sector 1.

In FIG. 4A, if the answer at step 4 is affirmative, step 8 is entered. Step 8 is also entered after the registers are initialized. In step 8, the test is whether the car with the number (CN) then under consideration, is at the committable position, a position at which the car is ready to initiate stopping at the lobby. If the answer to this test is negative (in FIG. 1 it would be negative because car 1 is moving away), CN is increased by one unit in step 12, meaning that the assignment attempt now shifts to car 2. For the purpose of illustration, assume that car 2 is descending at the indicated position. This will yield an affirmative answer at step 8, causing assignment of the sector 1 (containing floors 2–5) to car 2, that taking place in step 9. In step 10, both SN and CN are incremented by 1, but SN or CN have reached their respective maximums, something that would happen after each car in each sector is assigned. When that happens, SN and CN are set to 1 once again (on an individual basis in round-robin fashion). The sequence of operations assigns the sectors to the cars in a numerically cycling pattern.

Figure 4B:
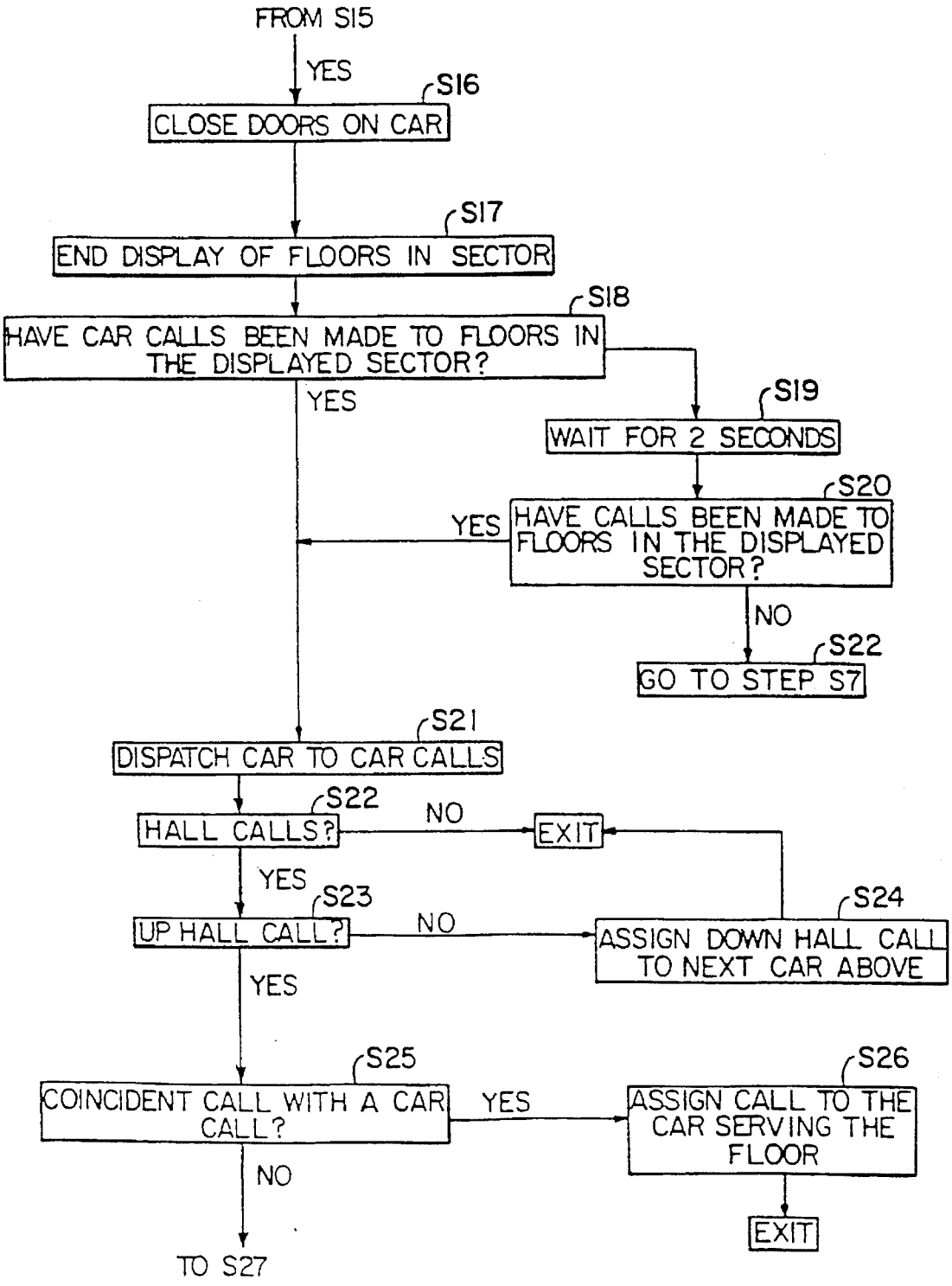
fig. 4B prior art

In FIG. 4A, step 11, the floors and sectors assigned to a car in the previous sequence are displayed in the lobby or main floor on the "floor service indicator" (FSI). Step 13 commands the opening of the car doors when the car reaches the lobby and holds them in the open position to receive passengers, who presumably enter the car intending to enter car calls on the car call buttons (on the car operating panel) to go to the floors. Car calls are limited to those floors appearing on the service indicator, step 14. In step 15, it is determined if the dispatching interval has elapsed. If not, the routine cycles back to step 13, keeping the doors open. Once the dispatching interval passes (producing an affirmative answer at step 15), the doors are closed at step 16 (FIG. 4B). The floor service indicator is then de-activated at step 17 (until the next sector is assigned to the car). Step 18 determines if permissible car calls (car calls to floors in the sector) have been made. Since the sector is assigned to the car without regard to the entry of car calls, there is no demand for the sector at the particular time that the car is at the lobby ready to receive passengers (when the sector is assigned to the car at the main floor or lobby). Hence, if permissible car calls have not been made, the routine goes to step 19, where it waits for a short interval (for example, two seconds) and repeats the test of step 18 (at step 0). If the answer is still negative, the routine moves back to step 8 on the instruction at step 22. The routine then considers the assignment of the next numerical sector to the next numerical car at the committable position. Since a numerical sequence is followed, conflicts between cars at the committable position at the same time does not encumber the assignment process.

Figure 4C:
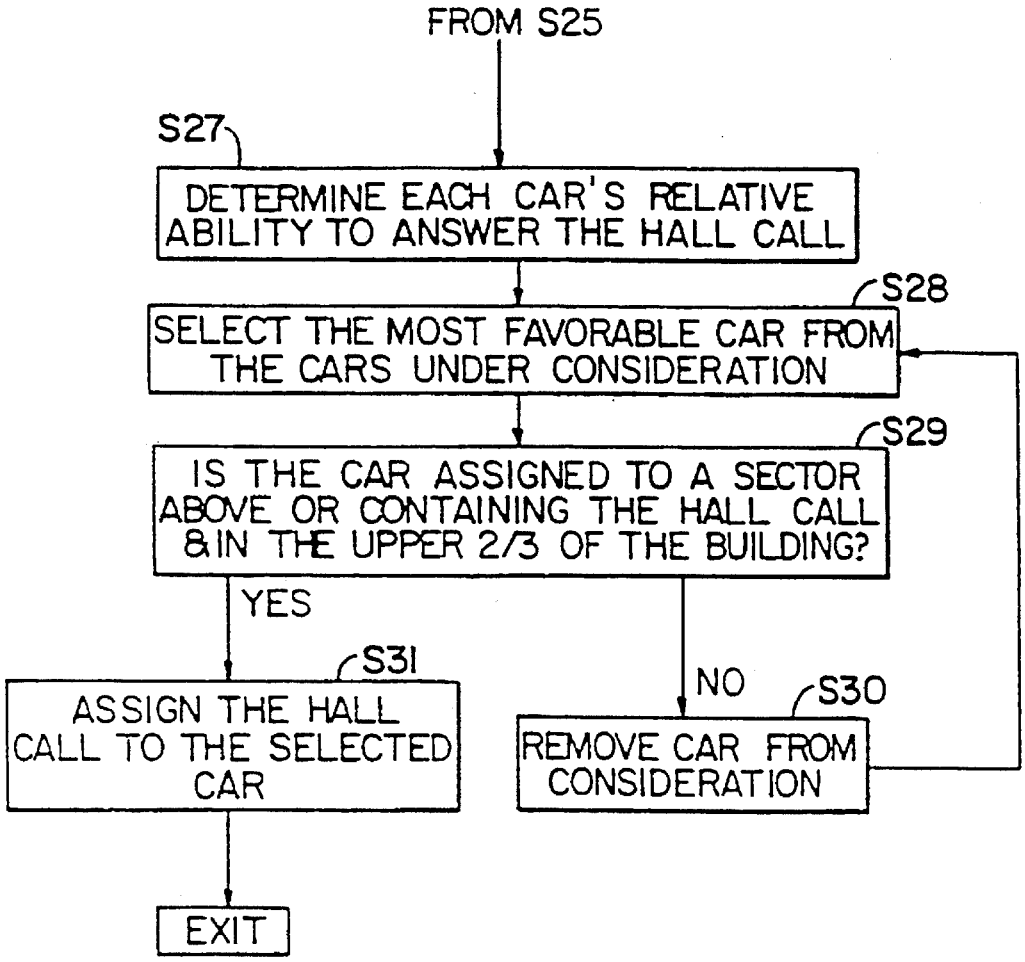
fig. 4 C prior art

Following step 21, FIG. 4B, in which a car is dispatched to the car calls in the sector to which the car is assigned, the routine considers up and down hall calls (signals HC in FIG. 1), which are requests for service made at one of the floors. These requests give rise to interfloor traffic, which is usually light during the up-peak period. Consequently, assignment of hall calls is given a comparatively low priority when the up-peak sectoring routine is in effect. Hall call assignments, at that time, are made in a way that brings cars back to the lobby as fast as possible for assignment to a sector, to minimize waiting time. In step 22, a simple test is made that finds if any hall calls have been made during the assignment cycle. If not, the routine is exited. If a hall call has been made on a floor, step 23 finds if it is a request to go down (down hall call) or up in the building. If it is a down hall call, in step 24, the hall call will be answered by the next available car traveling down from a location at or above the location of the hall call. Presumably, that assignment can be made according to the normal criteria, for instance, using the techniques described in the RSR Bittar patent for selecting a car for hall call assignment on a comparative basis. If it is found that there is an up hall call, step 25 finds if there is a coincident car call in one of the cars at the lobby (assigned to a sector). If the answer is yes, the up hall call will be assigned to that car. If the answer in step 25 is no, step 27 (FIG. 4C) determines each car's ability to answer the up hall call under conditional criteria, preferably using sequences described in the previous patents to Bittar et al, by which a car is selected from all the other cars for final assignment by considering the impact of the assignment on the overall system response. At step 28, the sequence selects, using a normal selection routine, the most favorable car to answer the hall call and tests, at step 29, if the car is serving a sector in the upper two-thirds of the building, and if that sector is the sector that contains the floor in which the hall call is registered, or is a higher sector (that is, above the sector containing the floor in which the hall call is placed). If the most favorable car cannot meet that test, step 30 increments the selection to the next most favorable car, and the program cycles through from the most favorable car to the least favorable until an affirmative is obtained to step 30, causing the assignment of the up hall call to the car meeting the test, this taking place in step 31.

Various changes to the above description may be made without departing from the gist of the invention.

We claim:

1. A method for dispatching elevators from the main floor to upper floors in a building in response to car calls made at the main floor and in response to the location of the cars, characterized by:

dividing the floors in the building into a plurality of sectors, adjacent the main floor, less than or equal to the plurality of cars, each sector comprising two or more contiguous floors, the sectors being contiguous with each other;

assigning a sector exclusively to one of the cars during a cycle of a cyclical assignment sequence that assigns sectors according to a preset sector order;

allowing a car to move away from the main floor in response to car calls only if the car calls are to floors in the sector assigned to the car;

indicating at the main floor the floors in a sector assigned to a car; and assigning a different sector to said one car if car calls meeting preset criteria are not made to floors in the sector after the sector is assigned to the car;

characterized by the improvement comprising, in response to a hall call being registered at the main floor:

estimating, for each sector-unassigned elevator car, a remaining response time value based on an estimated amount of time required for the elevator car to reach the lobby taking into account any car calls and any floor hall calls which the elevator car is presently assigned to serve;

comparing the remaining response time values of each of the sector-unassigned elevator cars of the plurality for selecting a sector-unassigned elevator car having a lowest remaining response time value and therefore being the sector-unassigned car which it is estimated will be the first to reach the lobby;

assigning a sector of the plurality of sectors to the selected sector-unassigned elevator car to form a sector-assigned elevator car; and moving the sector-assigned elevator car to the lobby to service the assigned sector.

* * * * *